United States Patent [19]

Gearhart

[11] 3,983,522

[45] Sept. 28, 1976

[54] TAPERING ELECTROSTATIC SHIELDS FOR DISC WINDINGS

[75] Inventor: Robert E. Gearhart, Rome, Ga.

[73] Assignee: General Electric Company, N.Y.

[22] Filed: Dec. 19, 1975

[21] Appl. No.: 642,579

[52] U.S. Cl. ..... 336/70

[51] Int. Cl.[2] ..... H01F 15/14

[58] Field of Search ..... 336/69, 70, 84, 186, 336/187

[56] References Cited

UNITED STATES PATENTS

| | | | |
|---|---|---|---|
| 3,160,838 | 12/1964 | Bedil | 336/69 |
| 3,380,007 | 4/1968 | Alrerson et al. | 336/70 |

*Primary Examiner*—Thomas J. Kozma

*Attorney, Agent, or Firm*—John J. Kelleher

[57] ABSTRACT

Capacitively coupled, transient response improving, series capacitance compensating electrostatic shields in a disc-wound winding progress inwardly from the outer portion of said winding in a tapered configuration or inwardly and outwardly in a conical-taper configuration, as the winding progresses from a high potential end. With this arrangement a substantial reduction in the change in series capacitance is effected between the compensated and uncompensated portion of said winding which minimizes unsatisfactory voltage transient build-up at the beginning of the uncompensated or lower series capacitance portion of said winding.

8 Claims, 4 Drawing Figures

28
26
24
30
A'
STATIC PLATE
22
A
B
C
D
E
F
G
H
J
K
L
M
N
P
Q
32
B'
C'
34
D'
E'
36
F'
20
G'
38
H'
PRIOR ART
J'
40
K'

TAPERING ELECTROSTATIC SHIELDS FOR DISC WINDINGS

BACKGROUND OF THE INVENTION

The present invention relates generally to inductive windings for electrical apparatus such as transformers, reactors and the like and more particularly to spirally wound inductive windings of the continuous disc type having an electrostatic shield arrangement that significantly improves the transient response of such windings.

It is well known that highly inductive windings, as in iron core transformers and reactors, when exposed to steep wave front impulse or transient voltages exhibit initially, an exponential distribution of voltage drop along the length of the winding with a very high-voltage gradient along the first few turns or disc coils of said winding. This extremely non-uniform distribution of voltage is due primarily to the unavoidable distributed capacitance between each incremental part of the winding and adjacent grounded parts such as the core and casing structure of the transformer. Such ground capacitance is referred to as "parallel" capacitance. Such a winding also possesses a distributed capacitance between turns and groups of turns, the sum of such capacitance being in series with the winding terminals. If this "series" capacitance alone were present, voltage distribution throughout the winding would be substantially uniform and linear, as it would be also if inductance alone were present. Inasmuch as series and parallel distributed capacitance are inherent characteristics, the voltage distribution of impulse voltages applied to such highly inductive windings is an extremely important design consideration.

The two principal winding configurations used in power transformers of high voltage and current rating are the "layer" type formed as a cylindrical helix or groups of concentric helices and the radial spiral "disc" type. In a continuous disc-type winding, each of a plurality of annular coils is wound as a radial spiral, the coils (i.e., radial spirals) being disposed in axial juxtaposition on a linear core and connected electrically in a series circuit relation.

It is also well known that a layer-type winding has a more linear transient voltage distribution than does a continuous disc-type winding, because the series capacitance of a layer winding is large relative to its parallel capacitance. However, for some high-voltage applications the disc-type winding is used in order to avoid a high voltage gradient (and consequent heavy insulation) between helical layers at normal operating voltages. Thus, medium power high-voltage transformers often have low-voltage windings of the layer type and high-voltage windings of the disc type. In such transformers the low-voltage winding is commonly located immediately adjacent the core and is surrounded by the higher voltage disc winding. Relative to the high-voltage winding, the entire low-voltage winding is approximately at ground potential, and the radial space between them, called the "main gap," is an essential design parameter. The radial dimension of the main gap is determined primarily by two considerations. One is the maximum permissible voltage stress accross the main gap at the low, power-circuit frequency and the other is the voltage stress arising from high-frequency transient voltages. In practice the latter consideration often controls the size of the main gap in disc-type transformers.

In disc windings with adjacent winding coils connected in a series circuit relation (i.e., a continuous disc winding) the non-linearity of coil-to-coil impulse voltage stress usually requires that the first several turns at the high-voltage end be provided with extra insulation. For reasons of economy and size it is desirable to reduce the size of the main gap and to reduce the amount of insulation between disc coils and between coil turns. All of these results may be accomplished if the normally steep exponential impulse voltage distribution, which particularly characterizes the continuous disc winding, can be favorably modified and brought closer to an ideal uniform linear distribution.

It is known that the transient voltage distribution between axially juxtaposed coils or groups of coils in a disc-type winding may be improved by various expedients which increase series capacitance relative to parallel capacitance. One such expedient is to place one or more shielding conductors between coil turns of the disc coils of a winding, as illustrated in U.S. Pat. No. 2,905,911 to KURITA. It is also known that these shield conductors or electrostatic shields become less effective as the distance from the high potential end of a winding to the electrostatic shield increases. Placing electrostatic shields, of the just mentioned type along the entire length of a disc-wound winding is considered poor design practice because of cost and size considerations and such designs are usually avoided. While it is true that more electrostatic shields will, in fact, improve the transient response of a disc-wound winding there is a region in such a winding, which is some calculable distance from a high potential end of same, where a point of diminishing returns is reached. Providing additional electrostatic shields beyond this region of the winding will result in a degree of transient response improvement that is not justified by the penalty that must be paid to obtain this improved response in terms of increased winding size and cost. Normal design practice is to discontinue electrostatic shields beyond this calculable distance. However, discontinuing such electrostatic shields other than at the end of a disc-wound winding creates problems that would not be present if electrostatic shields were continued throughout its entire length.

Abrupt changes in series capacitance occur when going from that portion of a disc-wound winding having electrostatic shields, hereinafter designated the compensated portion, to that portion of the same winding that does not have electrostatic shields, hereinafter designated the uncompensated portion. This sudden change in series capacitance results in unsatisfactory transient voltage build-up at the beginning of the low series capacitance or uncompensated portion of the winding. If possible, sudden changes in series capacitance of such disc-wound windings should be minimized to, in turn, minimize said transient voltage build-up.

SUMMARY OF THE INVENTION

In accordance with the present invention the transient response of the disc-wound winding is improved by locating electrostatic shields progressively inward from the outer portion of said winding in a tapered configuration or inward and outward from the outer and inner portions of said winding respectively, in a conical-taper configuration, as the winding progresses from a high potential end.

With such a shielding arrangement the change in capacitance from the shielded to the unshielded portion of the winding is substantially less precipitous than a non-tapering electrostatic shielding arrangement where said shields terminate other than at the end of said winding. This arrangement minimizes unsatisfactory transient voltage build-up at the beginning of the unshielded or lower series capacitance portion of said winding.

DESCRIPTION OF THE PRIOR ART

Figure 1:
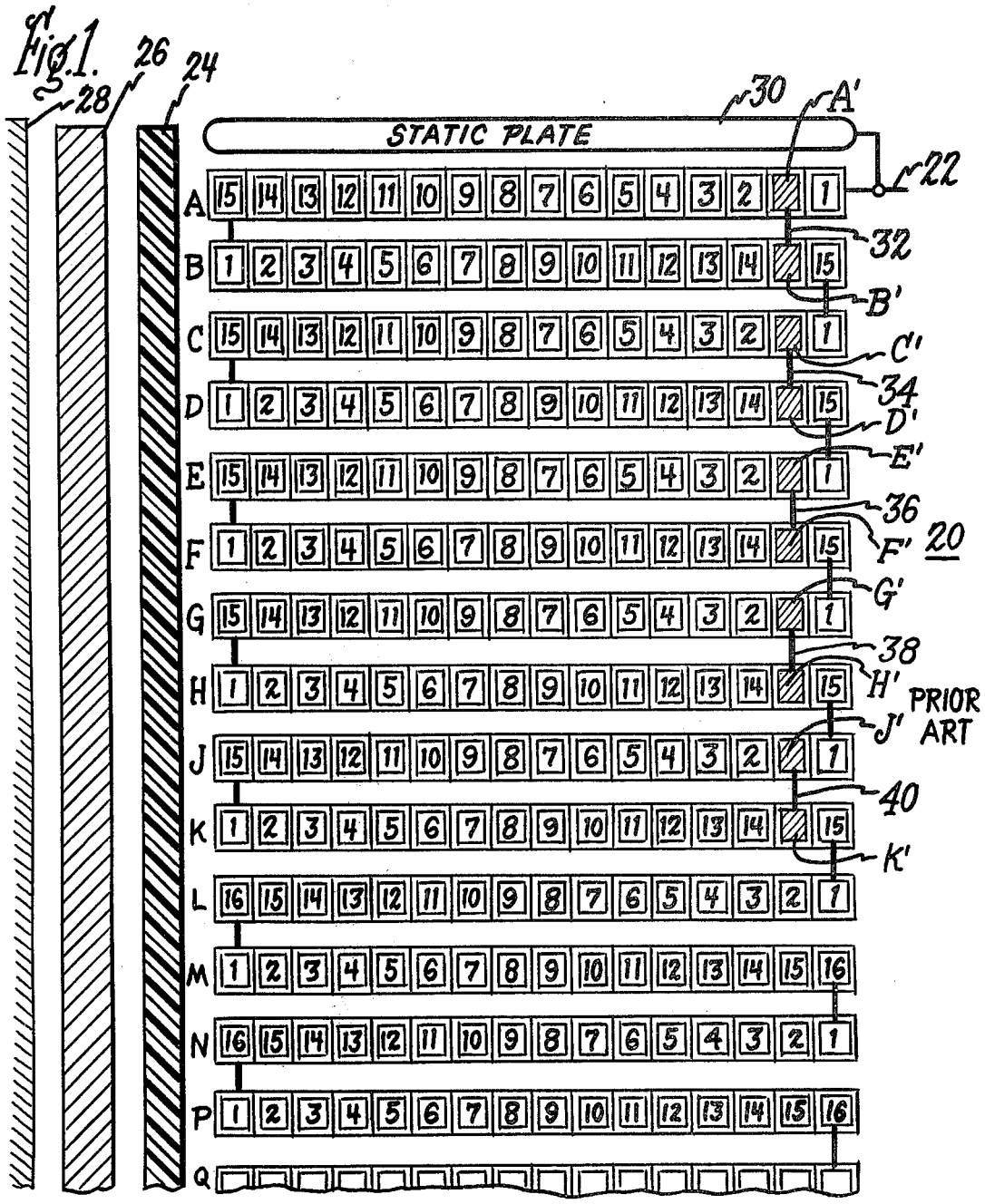
FIG. 1 is a diagrammatic sectional view, in elevation, taken on a radial plane, of a disc-wound winding incorporating prior art, non-tapering, electrostatic shields.

Referring now to the prior art depicted in FIG. 1 which is a diagrammatic sectional view in elevation, taken on a radial plane, of disc-wound high-voltage winding 20, incorporating conventional non-tapering electrostatic shields. Winding 20 includes a plurality of axially spaced spirally wound disc coils with only coils A through Q being depicted. Said coils A through Q are wound, alternately, radially inward from high voltage supply lead 22 and then radially outward with the finish-end of one disc coil being connected to the start end of an immediately adjacent coil in an electrical series circuit relation. High voltage disc-wound winding 20 is wound on high voltage winding cylinder 24. Low voltage winding 26 is wound around magnetic core 28. Core 28 and low voltage winding 26 are internal of and generally concentric with high voltage winding cylinder 24 and high voltage disc-wound winding 20. Transient voltage distribution improving static plate 30 is adjacent the high voltage end of winding 20 and is, in turn, connected to high voltage supply lead 22.

Insulated electrostatic shields A′ through K′ are located between the two outermost turns of disc coils A through K, respectively. Shield conductors A′ through K′ in adjacent disc coils A through K are connected together by electrical connections 32, 34, 36, 38 and 40 respectively, forming a series of non-tapering, floating, electrostatic shield pairs, from the high potential towards the low potential end of high voltage disc-wound winding 20.

When electrostatic shields teminate at some point other than the end of a winding as does electrostatic shield K′ in disc coil K of FIG. 1, there is an abrupt change or reduction in series capacitance beyond the shielded or compensated portion of the winding. This abrupt change in series capacitance causes an unfavorable voltage distribution at the beginning of the unshielded or uncompensated portion of the winding that is similar to the unfavorable voltage distribution that would be present at the high voltage end of winding 20 if electrostatic shields A′ through K′ were not incorporated therein.

DESCRIPTION OF THE PREFERRED EMBODIMENT

Figure 2:
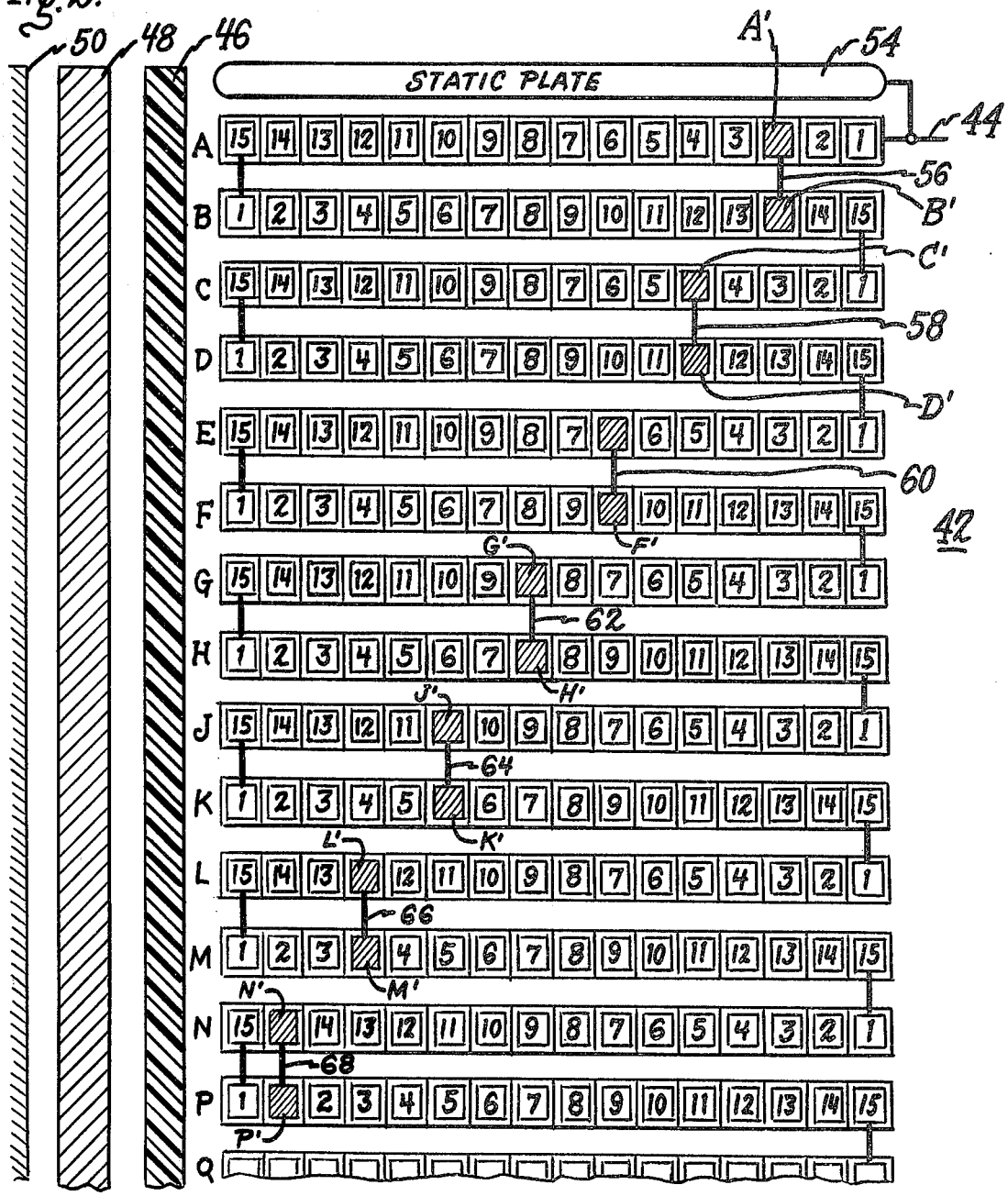
FIG. 2 is a diagrammatic sectional view, in elevation, taken on a radial plane, of a disc-wound winding showing electrostatic shields tapering inwardly from an outer portion and a high potential end of said winding.

Referring now to the remaining drawings and a preferred embodiment, wherein like numerals are used to indicate like parts throughout, in FIG. 2 a diagrammatic sectional view of disc-wound winding 42, in elevation, taken on a radial plane, incorporating the tapering electrostatic shield concept of the present invention is depicted. Winding 42 includes a plurality of axially spaced, spirally wound, disc coils with only coils A through Q being depicted. Said coils A through Q are wound, alternately, radially inward from high voltage supply lead 44 and then radially outward with the finish-end of one coil being connected to the start-end of an immediately adjacent coil in an electrical series circuit relation. High voltage disc-wound winding 42 is wound on high voltage winding cylinder 46. Low voltage winding 48 is wound around magnetic core 50. Core 50 and low voltage winding 48 are internal of and generally concentric with high voltage winding cylinder 46 and high voltage disc wound winding 42. Transient voltage distribution improving static plate 54 is adjacent the high voltage end of winding 42 and is, in turn, connected to high voltage supply lead 44.

Insulated electrostatic shield conductors A′ through P′ are located in disc coils A through P, respectively, each of said coils having a single shield conductor. Shield conductors A′ through P′ in adjacent disc coils are connected together, in shield conductor pairs, by electrical connections 56, 58, 60, 62, 64, 66, and 68, respectively. Shield conductors progress inwardly, in pairs, from the outer portion at the high potential end to the inner portion towards the low potential end of high voltage disc-wound winding 42. Shield-conductor pairs progress inwardly at the rate of two turns per disc coil pair. As shield conductors progress inwardly, their ability to increase the series capacitance of disc winding 42 is reduced by an amount that is in relation to their inward position in disc winding 42. As can be seen from the foregoing, the change in series capacitance between disc coil P and the next disc coil is quite low due to the relatively small difference in series capacitance added by shield conductor P′ and the inherent series capacitance of subsequent disc coils.

Figure 3:
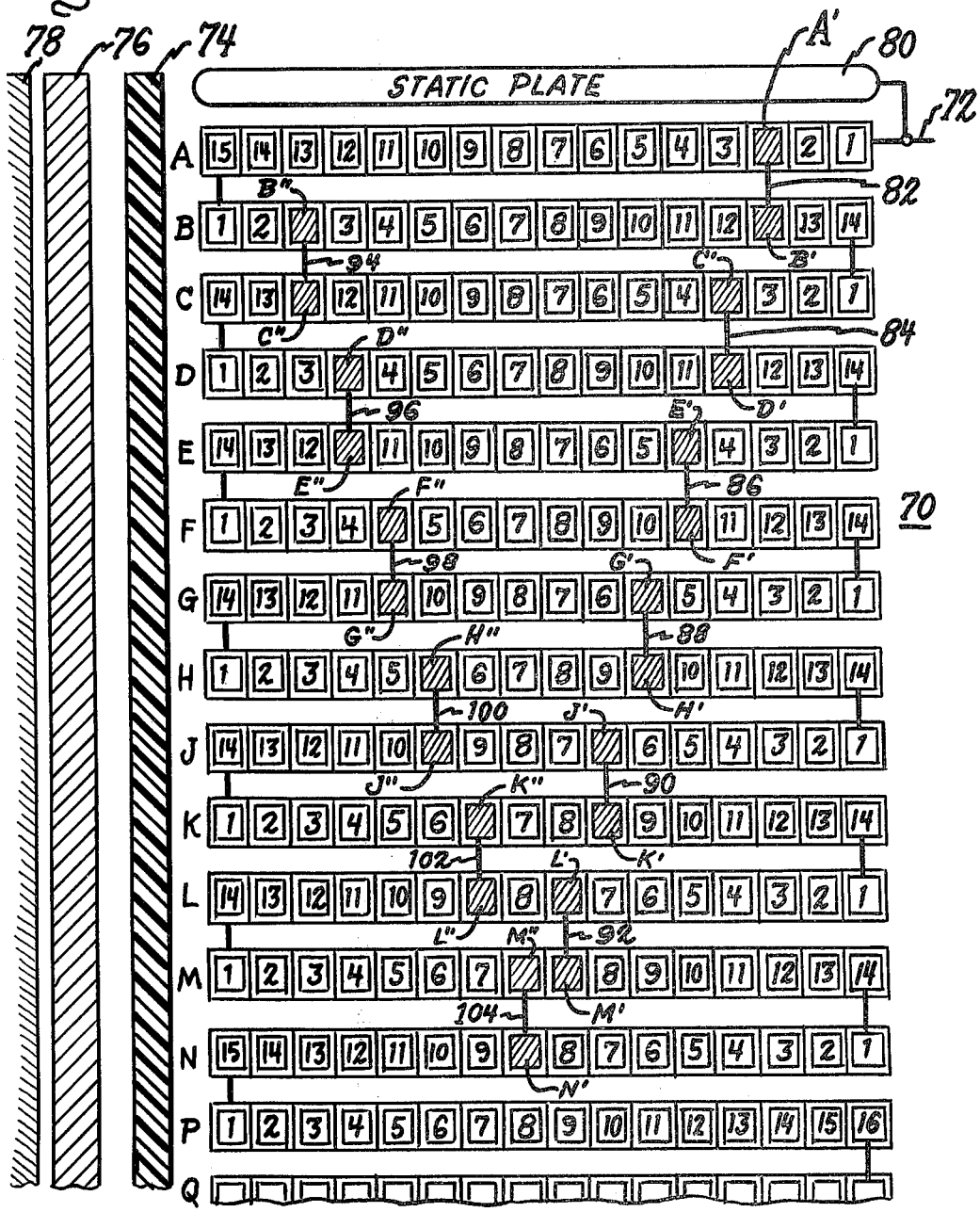
FIG. 3 is a diagrammatic sectional view, in elevation, taken on a radial plane, of a disc-wound winding showing electrostatic shields tapering inwardly and outwardly from the outer and inner portions respectively, and a high potential end of said winding.

Reference should here be made to FIG. 3, which is a diagrammatic sectional view, in elevation, taken on a radial plane, of disc-wound winding 70, incorporating the tapering electrostatic shield concept of the present invention. Winding 70 includes a plurality of axially spaced spirally wound, disc coils with only coils A through Q being depicted. Said coils A through Q are wound, alternately, radially inward from high voltage supply lead 72 and then radially outward, with the finish-end of one disc coil being connected to the start-end of an immediately adjacent disc coil in an electrical series circuit relation. High voltage disc-wound winding 70 is wound on high voltage winding cylinder 74. Low voltage winding 76 is disposed around magnetic core 78. Core 78 and low voltage winding 76 are internal of and generally concentric with high voltage winding cylinder 74 and with high voltage disc-wound winding 70. Transient voltage distribution improving static plate 80 is adjacent the high voltage end of winding 70 and is, in turn, connected to high voltage supply lead 72.

insulated electrostatic shield conductors B′ – B″ through M′ – M″ are located in disc coils B through M respectively, with each of said coils having two shield-conductors. In addition, disc coils A and N incorporate single shield-conductors A′ and N′ respectively. Shield conductors A′ through M′, in adjacent disc coils, are connected together in shield-conductor pairs by electrical connections 82, 84, 86, 88, 90 and 92 respectively. Shield conductor B″ through L″, in adjacent disc coils, are connected together in shield-conductor pairs by electrical connections 94, 96, 98, 100 and 102 respectively. In addition, shield-conductor M″ in disc coil M is connected to shield-conductor N′ in disc coil N by electrical connection 104. Shield conductors A′ through M′ progress inwardly, in pairs, from the outer portion at the high potential end towards the radial center of high voltage winding 70. Shield conductors B″ through N′ progress outwardly, in pairs, from the inner portion at the high potential end towards the radial center of high voltage winding 70. Shield-conductor pairs progress inwardly and outwardly at the rate of one turn per disc coil pair. As shield-conductor pairs progress outwardly towards the disc coil intra-connections at the opposite end of their respective disc coils, the effect on winding series capacitance in terms of their physical position would appear to be reduced. However, because the area of each subsequent shield conductor pair increases, the effect of the outwardly tapering shield is to add to the series capacitance of high voltage winding 70. In order to reduce this effect, the outward tapering shield has to taper outward at a greater rate than the inward tapering shields taper inward. This unequal taper arrangement is illustrated in FIG. 4.

Figure 4:
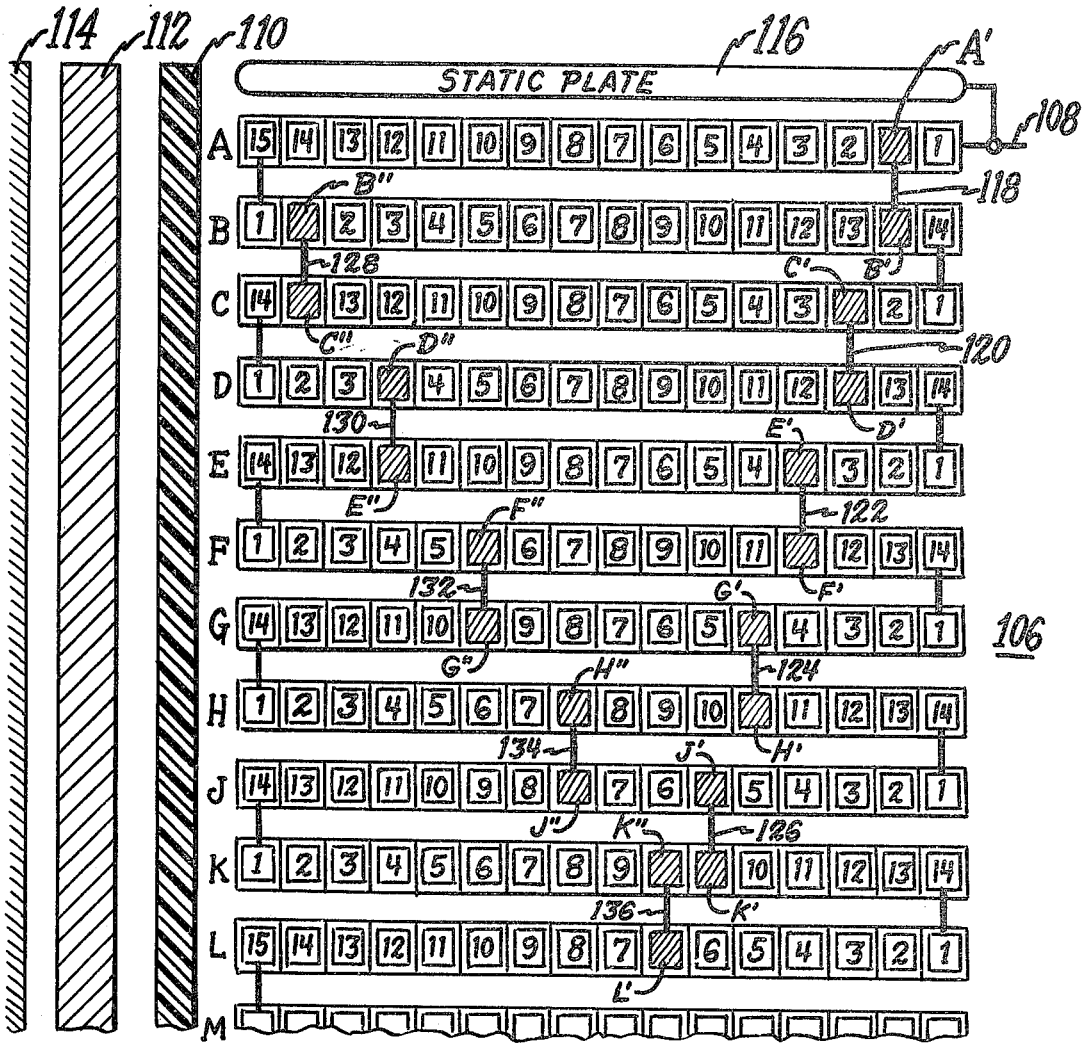
FIG. 4 is a diagrammatic sectional view, in elevation, taken on a radial plane, of a disc-wound winding showing electrostatic shields tapering outwardly at a greater rate than the inwardly tapering shields incorporated in said winding, taper inward.

Referring here to FIG. 4, which is a diagrammatic sectional view, in elevation, taken on a radial plane, of disc-wound winding 106 showing electrostatic shields tapering outwardly at a greater rate than the inwardly tapering shields incorporated therein, taper inward. Winding 106 includes a plurality of axially spaced, spirally wound, disc coils with only coils A through M being depicted. Said coils A through M are wound, alternately, radially inward from high voltage supply lead 108 and then radially outward with the finish-end of one coil being connected to the start-end of an immediately adjacent coil in an electrical series circuit relation. High voltage disc-wound winding 106 is wound on high voltage winding cylinder 110. Low voltage winding 112 is disposed around magnetic core 114. Core 114 and low voltage winding 112 are internal of and generally concentric with high voltage winding cylinder 110 and with high voltage disc-wound winding 106. Transient voltage distribution improving static plate 116 is adjacent the high voltage end of winding 106 and is, in turn, connected to high voltage supply lead 108.

Insulated electrostatic shield conductors B′ –B″ through K′ – K″ are located in disc coils B through K respectively, with each of said coils having two shield conductors. In addition, disc coil A incorporates single shield-conductor A′ and disc coil L incorporates single shield-conductor L′. Shield conductors A′ through K′ in adjacent disc coils, are connected together in shield-conductor pairs by electrical connections 118, 120, 122, 124 and 126, respectively. Shield conductors B″ through J″ in adjacent disc coils, are connected together in shield-conductor pairs by electrical connections 128, 130, 132 and 134, respectively. In addition, shield-conductor K″ in disc coil K is connected to shield-conductor L′ in disc coil L by electrical connection 136. Shield conductors A′ through K′ progress inwardly, in pairs, from the outer portion at the high potential end towards the radial center of high voltage winding 106. Shield conductors B″ through L′ progress outwardly, in pairs, from the inner portion at the high potential end towards the radial center of high voltage winding 106. Shield conductor pairs progressing inwardly do so at the rate of one turn per shield pair, while shield conductor pairs progressing outwardly do so at the rate of two turns per shield pair.

A winding having inward and outward tapering shields with an outward tapering shield that tapers outward at a greater rate than the inward tapering shields taper inward has less series capacitance added to such a winding by subsequent shield conductors that are further away from the high potential end of said winding than a winding having shield conductors that taper inwardly and outwardly at the same rate. This is so because capacitance, in general, is proportional to the product of the area to the first power but is proportional to the product of the voltage to the second power. Even though the area of the outward tapering shields is increasing in subsequent shields more remote from the high potential end of the winding, the voltage being coupled between these same subsequent disc coils decreases and this decrease in voltage which is to the second power, has a square factor, and hence a greater effect on the series capacitance contribution of said shields.

DISCUSSION

From the foregoing it can be seen that the electrostatic shields described herein are of the "floating" or electrically isolated type. In other words, the only electrical connection of significance between the electrostatic shield pairs and other parts of the disc-type winding, in which they are incorporated, is the capacitive coupling of these electrostatic shields with various conductor turns of said winding.

When describing the placement of electrostatic shields in disc windings of the type described herein, that portion of said winding having electrostatic shields is referred to herein as the compensated portion of the winding and that portion of the winding not having electrostatic shields is referred to herein as the uncompensated portion of the winding.

Three specific taper configurations and/or rates have been depicted in FIGS. 2, 3 and 4 and have been described herein in some detail. These taper rates and configurations are merely illustrative, as any number of taper rates and/or configurations could be used, depending upon winding design criteria, without deviating from the inventive concept described herein. For example, in FIGS. 2, 3 and 4 electrostatic shields are shown tapering inward and/or tapering outward at uniform rates. It is within the scope of the present invention to have electrostatic shields taper at a nonuniform rate. Instead of shield pairs progressing inwardly or outwardly one or two turns, adjacent shield pairs (i.e. two or more adjacent pairs) could be positioned inwardly or outwardly as the case may be, the same number of turns, in a direction that is parallel to the winding axis before resuming a particular inward or outward taper.

In the winding described in the preferred embodiment, a single-phase winding having both high and low potential ends is described. It should be noted that the present invention has application in a polyphase transformer where both ends of a winding are high potential ends as in a three-phase delta connected transformer. In a transformer having a winding connected in such a manner both ends of same would include tapering electrostatic shield conductors of the type described in the preferred embodiment.

I claim:

1. An electrostatic shielding device for inductive apparatus of the type having, a winding, including a plurality of generally coaxially disposed annular disc coils, each of said coils having a plurality of insulated conductor turns, each of said conductor turns having at least one strand;

spirally wound, in the same direction, alternately radially inward and radially outward, beginning with an initial coil at one end of said winding and terminating with a final coil at the opposite end of said winding, a finish-end of a coil being connected to a start-end of an immediately adjacent coil to form a winding connected in an electrical series circuit relation, at least the start end of said initial coil being for connection to a high potential source, wherein the improvement comprises:

at least one electrostatic shield-conductor between turns of a plurality of spirally wound disc coils of said winding, selected shield-conductors in some adjacent spirally wound coils being connected together in shield-conductor pairs, said shield-conductor pairs progressing inwardly from an outer portion of said winding, shield-conductors of said inwardly progressing shield-conductor pairs being the outermost shield-conductors of the spirally wound disc coils in which they are located, and outermost shield-conductor pair being located near a high-potential end of said winding.

2. Electrostatic shielding for inductive apparatus, as defined in claim 1, wherein said shield-conductor pairs progress inwardly from an outer portion of said winding and outwardly from an inner portion of said winding.

3. Electrostatic shielding for inductive apparatus, as defined in claim 1, wherein said inwardly progressing shield-conductor pairs progress inward at a nonuniform rate.

4. Electrostatic shielding for inductive apparatus, as defined in claim 2, wherein said outwardly progressing shield-conductor pairs progress outward at a significantly greater rate than said inwardly progressing shield-conductor pairs progress inward.

5. An electrostatic shielding device for inductive apparatus of the type having, a winding, including a plurality of generally coaxially disposed annular disc coils, each of said coils having a plurality of insulated conductor turns, each of said conductor turns having at least one strand;

spirally wound, in the same direction, alternately radially inward and radially outward, beginning with an initial coil at one end of said winding and terminating with a final coil at the opposite end of said winding, a finish-end of a coil being connected to a start-end of an immediately adjacent coil to form a winding connected in an electrical series circuit relation, at least the start end of said initial coil being for connection to a high potential source, wherein the improvement comprises:

at least one electrostatic shield-conductor between turns of a plurality of spirally wound disc coils of said winding, selected shield-conductors in adjacent spirally wound coils being connected together in shield-conductor pairs, said shield-conductor pairs progressing inwardly from an outer portion of said winding to the central region between radial inner and radial outer boundaries of the conductor turns of said winding, shield — conductors of said inwardly progressing shield-conductor pairs being the outermost shield-conductors of the spirally wound disc coils in which they are located, an outermost shield-conductor pair being located near a high-potential end of said winding.

6. An electrostatic shielding device for inductive apparatus, as defined in claim 5, wherein said shield-conductor pairs progress inwardly from an outer portion of said winding and outwardly from an inner portion of said winding to the central region between radial inner and radial outer boundaries of the conductor turns of said winding.

7. An electrostatic shielding device for inductive apparatus, as defined in claim 5, wherein said inwardly progressing shield-conductor pairs progress inward at a nonuniform rate.

8. An electrostatic shielding device for inductive apparatus, as defined in claim 6, wherein said outwardly progressing shield-conductor pairs progress outward at a significantly greater rate than said inwardly progressing shield-conductor pairs progress inward.

* * * * *